US007296797B2

(12) United States Patent
Crawford

(10) Patent No.: US 7,296,797 B2
(45) Date of Patent: Nov. 20, 2007

(54) CARD GAME

(76) Inventor: Laren F. Crawford, 3318 Viewpoint Dr., Medford, OR (US) 97504

( * ) Notice: Subject to any disclaimer, the term of this patent is extended or adjusted under 35 U.S.C. 154(b) by 93 days.

(21) Appl. No.: 11/242,564

(22) Filed: Oct. 3, 2005

(65) Prior Publication Data

US 2007/0075493 A1 Apr. 5, 2007

(51) Int. Cl.
*A63F 3/00* (2006.01)

(52) U.S. Cl. ..... 273/242; 273/236

(58) Field of Classification Search ..... 273/236, 273/242, 243

See application file for complete search history.

(56) References Cited

U.S. PATENT DOCUMENTS

| | | | | |
|---|---|---|---|---|
| 1,713,455 | A | 5/1929 | Stickney | |
| 1,798,701 | A | 3/1931 | Reed | |
| 2,316,862 | A | 4/1943 | Haggard | |
| 2,479,747 | A | 8/1949 | Lachance | |
| 3,565,436 | A | 2/1971 | Opmeer | |
| 4,560,170 | A | 12/1985 | Enyi | |
| 4,572,514 | A | 2/1986 | Aponte | |
| 4,955,618 | A * | 9/1990 | Growall | 273/258 |
| 5,026,069 | A | 6/1991 | Leask | |
| 5,150,908 | A | 9/1992 | Codinha | |
| 5,388,837 | A | 2/1995 | Hoffman | |
| 5,484,157 | A | 1/1996 | King | |
| 5,496,037 | A | 3/1996 | Rumph | |
| 5,803,455 | A | 9/1998 | Falzarano | |
| 5,954,332 | A | 9/1999 | Mero et al. | |
| 6,209,873 | B1 | 4/2001 | DeGeorge | |
| 6,224,056 | B1 | 5/2001 | Jones | |
| 6,450,498 | B1 | 9/2002 | Rombone | |
| 6,561,513 | B1 | 5/2003 | DeGeorge | |
| 2002/0067000 | A1 | 6/2002 | Larson et al. | |

OTHER PUBLICATIONS

Shawkenaw Palace Copyright Registration Author-Laren F. Crawford.

Irag . . . Most Wanted Playing Cards Issued by Pentagon.

* cited by examiner

*Primary Examiner*—Vishu K. Mendiratta
(74) *Attorney, Agent, or Firm*—Gerald D. Haynes; R. Keith Harrison

(57) ABSTRACT

A method of playing a card game is disclosed. The method includes providing a game board having multiple base areas, a destination and an advancement path having a plurality of advancement spaces between the base areas and the destination. A set of the playing cards is dealt from the deck to each of multiple players. At least one game piece is provided on each of the base areas for each of the players. Each of the players draws one of the playing cards from his or her dealt set of said playing cards and advances the game pieces from his or her base areas on the advancement path for a number of the advancement spaces corresponding to a numerical value displayed on the drawn playing card.

17 Claims, 3 Drawing Sheets

CARD GAME

FIELD OF THE INVENTION

The present invention relates to card games. More particularly, the present invention relates to a card game in which game pieces are incrementally advanced around a game board to a palace destination according to numbers displayed on playing cards, preferably customized player cards having the same images as those displayed on Iraqi Most Wanted playing cards, dealt to each of multiple players.

BACKGROUND OF THE INVENTION

Card games are popular among persons of all ages because they require participants to use strategy and skill in an attempt to out-maneuver their opponents and win the game. A standard card deck includes 52 playing cards divided into four suits (spades, diamonds, hearts and clubs) each having multiple card types numbered from two to ten, in addition to a king card, a queen card, a jack card and an ace card. Recently, the Pentagon released a 52-card deck of playing cards known as the Iraqi Most Wanted playing cards. These playing cards feature fifty-two of those who were the most wanted Iraqi officials in Saddam Hussein's regime at the time the Operation Iraqi Freedom war started in 2003. The Iraqi Most Wanted playing cards were designed to aid U.S. military personnel in identifying and capturing these officials.

SUMMARY OF THE INVENTION

The present invention is generally directed to a method of playing a card game. The method includes providing a game board having multiple base areas, a destination and an advancement path having a plurality of advancement spaces between the base camps and the destination. A set of the playing cards is dealt from the deck to each of multiple players. At least one game piece is provided on each of the base camps for each of the players. Each of the players draws one of the playing cards from his or her dealt set of said playing cards and advances the game pieces from his or her base camps on the advancement path for a number of the advancement spaces corresponding to a numerical value displayed on the drawn playing card.

BRIEF DESCRIPTION OF THE DRAWINGS

The invention will now be described, by way of example, with reference to the accompanying drawings, in which.

DETAILED DESCRIPTION OF THE INVENTION

Figure 1:
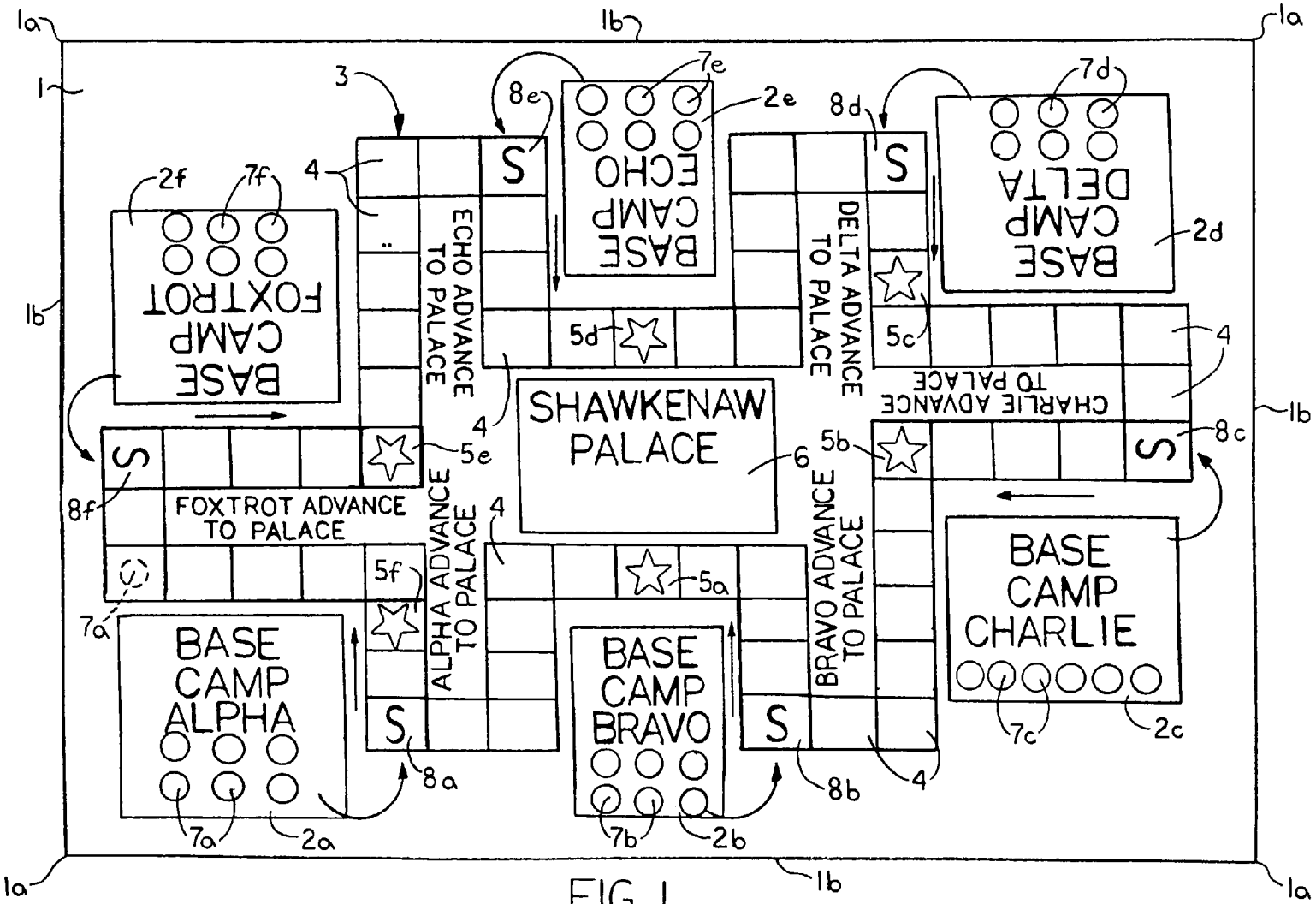
FIG. 1 is a top view of a game board which is suitable for implementation of the card game according to the present invention.

Referring to the drawings, an illustrative game board which is suitable for implementation of the card game of the present invention is generally indicated by reference numeral 1. The game board 1 includes multiple base areas 2 which are placed in various locations on the game board 1. For example, the base areas 2 may be located in general proximity to the corners 1*a* and edges 1*b* of the game board 1. Preferably, there are six base areas 2 provided on the game board 1. These may include, for example, a base camp Alpha 2*a*; a base camp Bravo 2*b*; a base camp Charlie 2*c*; a base camp Delta 2*d*; a base camp Echo 2*e*; and a base camp Foxtrot 2*f*.

An advancement path 3 extends among and between the base areas 2. The advancement path 3 includes a start space 8 for each of the base areas 2. Preferably, the advancement path 3 includes a start space 8*a* for the base camp Alpha 2*a*, a start space 8*b* for the base camp Bravo 2*b*, a start space 8*c* for the base camp Charlie 2*c*, a start space 8*d* for the base camp Delta 2*d*, a start space 8*e* for the base camp Echo, and a start space 8*f* for the base camp Foxtrot 2*f*. Multiple, adjacent advancement spaces 4 extend between the start spaces 8.

The advancement path 3 further includes a checkpoint space 5 for each of the base areas 2. Each checkpoint space 5 may be designated by a star, as shown in FIG. 1. Preferably, the checkpoint spaces 5 for the respective base areas 2 are separated from the start spaces 8 of the respective base areas 2 by the same number of advancement spaces 4. For example, the checkpoint space 5*a* for the base camp Alpha 2*a* is separated from the start space 8*a* for the base camp Alpha 2*a* by six adjacent advancement spaces 4. The same applies to the number of advancement spaces 4 between the checkpoint spaces 5 and the respective start spaces 8 for the remaining base areas 2. A destination 6, which may be designated "Shawkenaw" ((shock-and-awe) palace, or the like, is provided in substantially the center of the game board 1 and is surrounded by the advancement path 3.

In implementation of the card game, as will be hereinafter further described, multiple game pieces 7 are initially placed on each base area 2 and then incrementally and sequentially advanced around the advancement path 2 to the destination 6. The game pieces 7 may include a selected number, typically six, game pieces 7*a* for the base camp Alpha 2*a*; multiple game pieces 7*b* for the base camp Bravo; multiple game pieces 7*c* for the base camp Charlie 2*c*; multiple game pieces 7*d* for the base camp Delta 2*d*; multiple game pieces 7*e* for the base camp Echo 2*e*; and multiple game pieces 7*f* for the base camp Foxtrot 2*f*. Preferably, the game pieces 7 for each base area 2 have a color which differs from that of the game pieces 7 for the other base areas 2.

Figure 2:
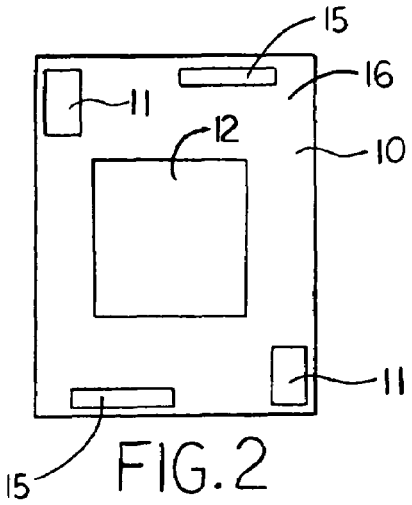
FIG. 2 is a schematic illustration of a general format for each of multiple customized player cards having the images contained on Iraqi Most Wanted playing cards suitable for implementation of the card game.
Figure 7:
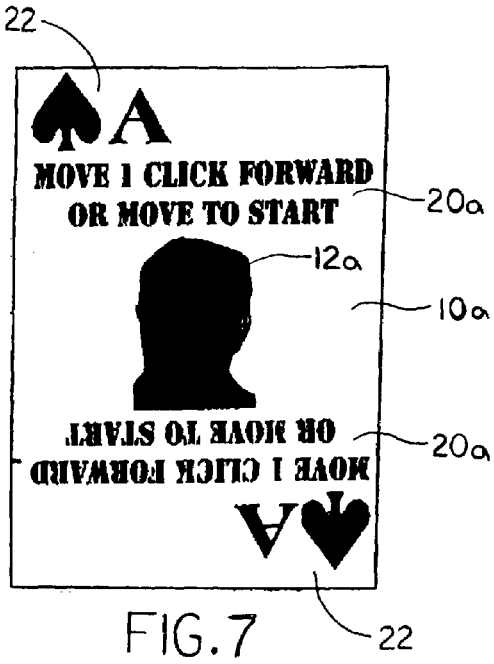
FIGS. 7-8 are examples of various player cards suitable for implementation of the card game.
Figure 8:
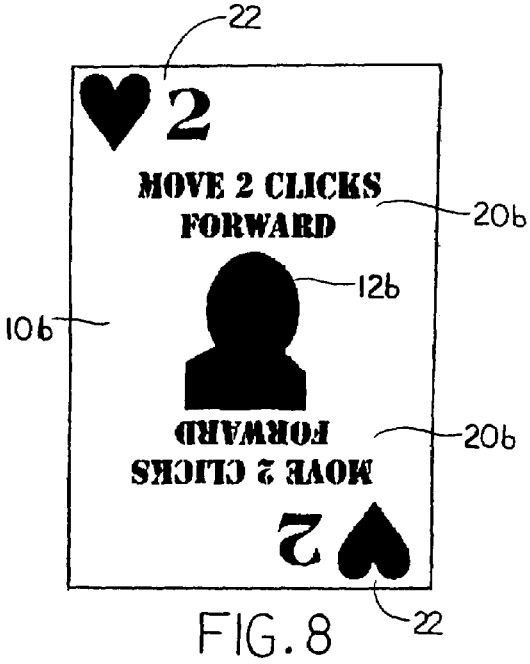

As shown in FIGS. 2, 7 and 8, each of multiple playing cards 10 is used in implementation of the card game. The playing cards 10 may be a standard 52-card deck of playing cards with additional wild cards added. Preferably, however, the playing cards 10 are a 52-card deck of customized player cards having the same images as those displayed on Iraqi Most Wanted playing cards with eight additional wild cards with images for a total of a customized sixty playing card deck. As shown in FIG. 2, each of the customized playing cards 10 generally includes a front face 16 on which is provided a suit and number identification section 11, typically at opposite corners of the playing card 10, which identifies the suit and number of the playing card 10. An image section 12 is provided in the approximate center of the front face 16 and includes a photograph or caricature pertaining to the theme of the game. For example, the most wanted officials in Saddam Hussein's regime can be used. Accordingly, the officials who were the fifty-two most wanted Iraqi officials in Saddam Hussein's regime at the beginning of Operation Iraqi Freedom are displayed on fifty-two customized playing cards 10, respectively. A number of moves section 15 may be provided on the front face 16 of each playing card 10. A number which corresponds to the number of advancement spaces 4 on the advancement path 3 that the playing card 10 entitles a player to take is provided on the number of moves section 15. That number may or may not correspond to the number displayed in the suit and number identification section 11.

One example of a player card 10*a* is shown in FIG. 7 and includes at least one section 20*a* which entitles a player to either move one advancement space 4 forward on the advancement path 3 or move another one of his or her game pieces 7 from the base area 2 to the start space 8 of his or her base area 2. The player card 10*a* may further include one or a pair of suit identification sections 22. A caricature or other image 12*a* is provided in the image section 12 of the player card 10*a*.

A second example of a player card 10*b* is shown in FIG. 8. One or a pair of suit identification sections 22 is provided on the player card 10*b*. A caricature or other image 12*b* is provided on the image section 12 of the player card 10*b*. One or a pair of number of moves sections 20*b* is further provided on the player card 10*b*.

Figure 3:
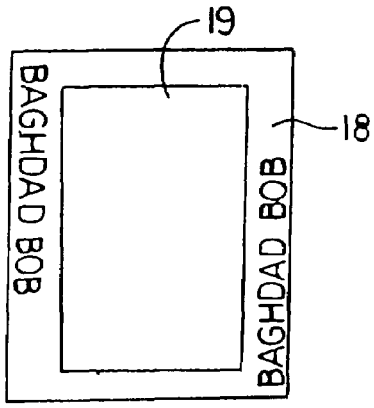
FIG. 3 is a schematic illustration of a general format for a wild card suitable for implementation of the card game.
Figure 5:
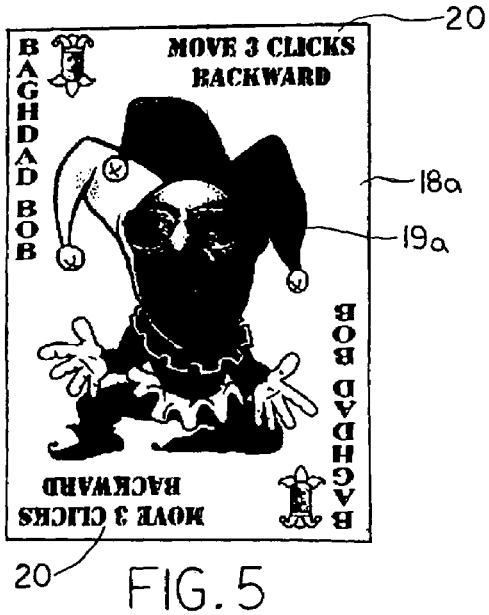
FIGS. 5-6 are examples of various wild cards suitable for implementation of the card game.
Figure 6:
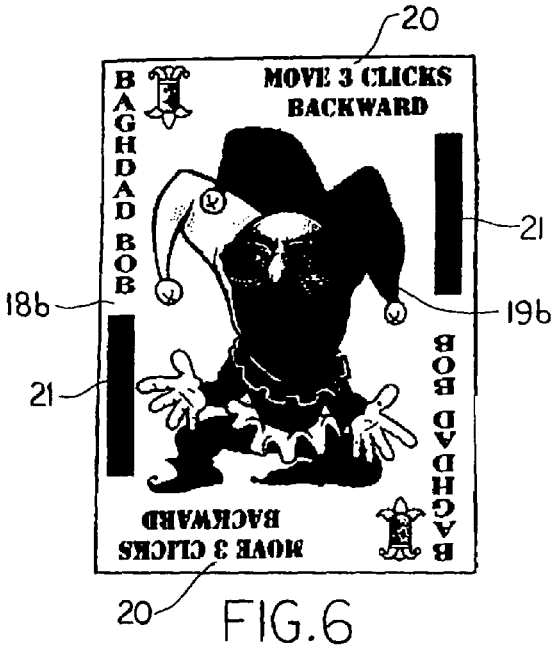

As shown in FIGS. 3, 5 and 6, according to the card game of the present invention, the deck of playing cards 10 preferably further includes multiple wild cards 18, a general format of which is shown in FIG. 3. Preferably, the card game uses eight wild cards 18 for a total of sixty customized playing cards. As shown in FIG. 3, each wild card 18 may include an image section 19 on which is displayed an image or caricature of a humorous or other figure.

One example of a wild card 18*a* suitable for the card game is shown in FIG. 5. The wild card 18*a* includes a caricature 19*a*, as well as one or a pair of number of moves sections 20. For example, one or a pair of number of moves sections 20 may be provided adjacent to the upper, lower or both upper and lower edges of the wild card 18*a*. The number of moves section 20 indicates the number of advancement spaces 4 on the advancement path 3 that the wild card 18*a* entitles a player to take when he or she plays the wild card 18*a* during the card game. A caricature or other image 19*a* is provided in the image section 19 of the wild card 18*b*.

A second example of a wild card 18*b* which is suitable for the card game is shown in FIG. 6 and includes one or a pair of color stripes 21 typically provided along one or both edges of the wild card 18*b*. The color stripe or stripes 21 on each wild card 18*b* corresponds in color to the color of one of the game pieces 7. A caricature or other image 19*b* is provided in the image section 19 of the wild card 18*b*.

In typical implementation of the card game, six players sit around the game board 1, with three players on each side. Each of the players chooses a base area 2. Multiple game pieces 7 are initially placed on each base area 2 on the game board 1, as indicated in step S1 of FIG. 4. Typically, six of the game pieces 7 are placed on each base area 2, although fewer of the game pieces 7 can be placed on each base area 2 depending on time constraints, for example. As indicated in step S2 of FIG. 4, each player then places one game piece 7 on the start space 8 of his or her base area 2.

A "supply sergeant" or dealer is selected from among the multiple players. The dealer may be selected by, for example, the drawing of playing cards 10 from the card deck, in which case the player who draws the highest card becomes the dealer. As indicated in step S3 of FIG. 4, the dealer deals a set of multiple, typically five, playing cards 10 in the face-down position to each of the multiple players. In the case of five players, the dealer typically deals a set of six playing cards 10 to each player.

Figure 4:
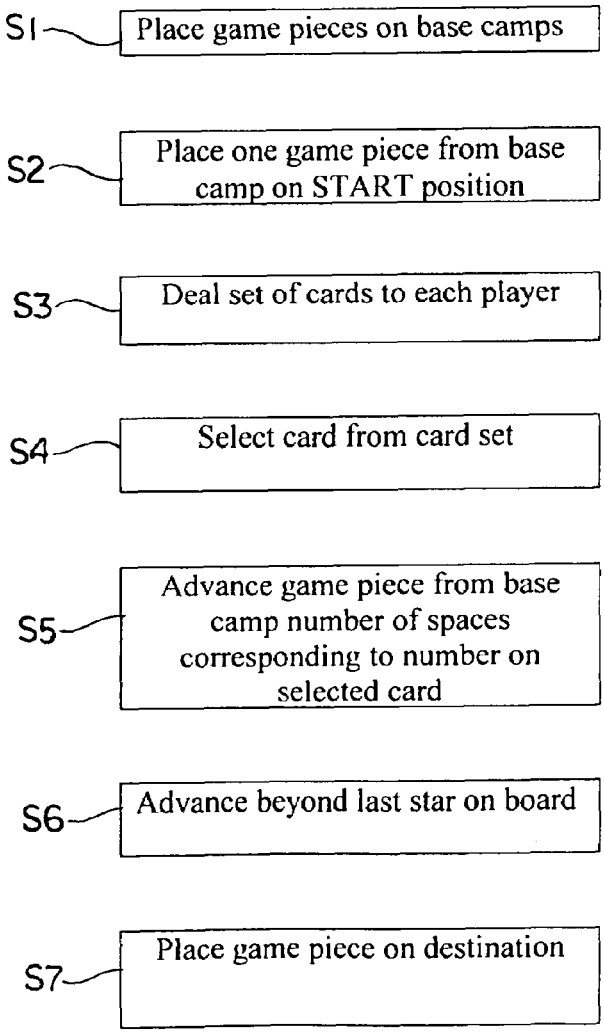
FIG. 4 is a flow diagram which summarizes sequential playing steps in implementation of the card game.

As indicated in step S4 of FIG. 4, one of the players selects a card from his or her set of dealt cards. In typical play, the player to the left of the dealer is the player who first selects a card from his or her set of dealt cards. The player then lays his or her card in full view of the other players and advances his or her game piece 7 the number of advancement spaces 4 which corresponds to the numerical value of the selected playing card 10 and the number indicated in the number of moves section 15, as indicated in step S5 of FIG. 4. For example, in the event that the player's base area 2 is base camp Alpha 2*a* and that player draws a playing card 10, the number of moves section 15 of which entitles the player to move his or her game piece 7*a* seven advancement spaces 4 forward, then the player advances his or her game piece 7*a* from the start space 8*a* to the seventh advancement space 4 in the direction of the arrow, as shown in phantom in FIG. 1. In typical play, each king playing card 10 selected from the set of dealt playing cards 10 entitles a player to move another one of his or her game pieces 7 from his or her base area 2 to his or her start space 8; each queen playing card 10 entitles the player to advance his or her game piece 7 twelve advancement spaces 4 forward on the advancement path 3; and each ace playing card 10 entitles the player to advance his or her game piece 7 either one advancement space 4 forward or another of his or her game pieces 7 from the base area 2 to the start space 8. Each jack playing card 10 entitles the player to trade places of his or her game piece 7 with any other player's game piece 7 at any location on the advancement path 3. Each wild card 18 entitles the player to move his or her game piece 7 three advancement spaces 4 backwards.

Each player takes turns drawing a playing card 10 from the set of playing cards 10 dealt to them and advances his or her game piece 7 on the advancement path 3 in the manner which was heretofore described with respect to steps S4 and S5 of FIG. 4. As a player advances his or her game piece 7 to or beyond the last checkpoint space 5 on the advancement path 3 from his or her base area 2, that player must use a playing card 10 having a value of seven or less to advance his or her game piece 7 to the destination 6. Accordingly, the player then places his or her game piece 7 on the destination 6, as indicated in step S7 of FIG. 4. A player must have a King, Ace, or a wild card 18 with a color stripe Y having the same color as the player's playing piece 7 to transfer another of his or her game pieces 7 from the base area 2 to the start space 8.

In the event that a second player's game piece 7 lands on a first player's game piece 7 on the advancement path 3, the second player can "capture" the game piece 7 of the first player as a "spy" by replacing the first player's game piece 7 with the second player's game piece 7 on the advancement space 4. In the event that a player's game piece 7 lands on a checkpoint space 5, the player may, on his or her next turn, play any playing card 10 having a value of ace through 5 to move the game piece 7 to another checkpoint space 5. The player can skip the game piece 7 of any other player to reach the next checkpoint space 5 on the advancement path 3. Alternatively, at his or her discretion, the player can play a wild card 18 to move the game piece 7 backwards three checkpoint spaces 5.

In the event that one of the players is dealt a wild card 18*b* the color stripe 21 of which is the same as that of the player's game pieces 7, the player may be given three options: move another of the player's game pieces 7 from his or her base area 2 to his or her start space 8; send one game piece 7 of each of the other player's game pieces which have arrived at the destination 6, from the destination 6 back to those players' base areas 2; or move his or her game piece 7 back three advancement spaces 4. Any player can play a wild card 18 which entitles him or her to advance his or her game piece 7 the number of advancement spaces 4 which is indicated on the number of moves section 20.

After all players have used all five of their playing cards 10, the players may pass the playing cards 10 to a discard pile (not illustrated). At that point, the dealer can either deal an additional round (typically five additional playing cards 10 to each player). The dealer may deal multiple rounds until all of the playing cards 10 have been dealt to the players. The dealer then passes the deck to the next player typically on his or her left, for example. Alternatively, after having dealt one or more rounds of the playing cards 10, the dealer can pass all playing cards 10 in the card deck to the player on his or her left, for example, in which case that player will become the "supply sergeant" or dealer. The first player to advance all of his or her game pieces 7 from his or her base area 2 to the destination 6 wins the game.

While the preferred embodiments of the invention have been described above, it will be recognized and understood that various modifications can be made in the invention and the appended claims are intended to cover all such modifications which may fall within the spirit and scope of the invention.

Having described my invention with the particularity set forth above, I claim:

1. A method of playing a card game, comprising:

providing a game board having a plurality of base areas, a destination and an advancement path having a plurality of advancement spaces between said plurality of base areas and said destination;

providing a deck of playing cards;

dealing a set of said deck of playing cards from said deck to each of a plurality of players;

providing at least one game piece on each of said plurality of base areas for each of said plurality of players;

having each of said players draw one of said playing cards from said set of said deck of playing cards;

having each of said players advance said at least one game piece from said each of said plurality of base areas on said advancement path for a number of said advancement spaces corresponding to a numerical value displayed on said one of said playing cards; and having a first one of said players capture at least one game piece of a second one of said players when at least one game piece of said first one of said players lands on one of said advancement spaces occupied by said at least one game piece of said second one of said players by having said at least one game piece of said second one of said players replaced by said at least one game piece of said first one of said players on said one of said advancement spaces.

2. The method of claim 1 wherein said providing at least one game piece on each of said plurality of base areas comprises providing a plurality of game pieces on each of said plurality of base areas.

3. The method of claim 1 further comprising providing a plurality of checkpoint spaces corresponding in number to said plurality of base areas on said advancement path and wherein said having each of said players advance said at least one game piece from said each of said plurality of base areas on said advancement path comprises having each of said players advance said at least one game piece on said plurality of checkpoint spaces.

4. The method of claim 3 wherein a plurality of said advancement spaces are provided between each of said plurality of checkpoint spaces and a corresponding one of said base areas and wherein said having each of said players advance said at least one game piece from said each of said plurality of base areas on said advancement path comprises having each of said players advance said at least one game piece on said plurality of advancement spaces provided between each of said plurality of checkpoint spaces and a corresponding one of said base areas.

5. The method of claim 4 wherein said plurality of said advancement spaces comprises six of said advancement spaces and wherein said having each of said players advance said at least one game piece from said each of said plurality of base areas on said advancement path comprises having each of said players advance said at least one game piece on said six of said advancement spaces.

6. The method of claim 1 wherein said deck of playing cards comprises a deck of Iraqi Most Wanted playing cards and wherein said dealing a set of said deck of playing cards from said deck to each of a plurality of players comprises dealing a set of said deck of Iraqi Most Wanted playing cards from said deck of Iraqi Most Wanted playing cards to said each of a plurality of players.

7. The method of claim 1 wherein said deck of playing cards comprises a standard deck of playing cards and wherein said dealing a set of said deck of playing cards from said deck to each of a plurality of players comprises dealing a set of said standard deck of playing cards from said deck to said each of a plurality of players.

8. The method of claim 1 further comprising a plurality of wild cards provided in said deck of playing cards and wherein said dealing a set of said deck of playing cards from said deck to each of a plurality of players comprises dealing at least one of said plurality of wild cards from said deck to said each of a plurality of players, and further comprising having said each of said plurality of players move at least one of said plurality of advancement spaces backwards on said advancement path by playing said at least one of said plurality of wild cards.

9. A method of playing a card game, comprising:

providing a game board having a plurality of base areas, a destination and an advancement path having a plurality of advancement spaces between said plurality of base areas and said destination and a plurality of start spaces on said advancement path;

providing a deck of playing cards having at least one wild card;

dealing a set of said deck of playing cards from said deck to each of a plurality of players;

providing at least one game piece on each of said plurality of base areas for each of said plurality of players;

having each of said players repeatedly and sequentially draw playing cards from said set of said deck of playing cards;

having each of said players sequentially advance said at least one game piece from said each of said plurality of base areas on said advancement path for numbers of said advancement spaces corresponding to numerical values displayed on said playing cards;

having at least one of said plurality of players draw at least one of said at least one wild card from said set of said deck of playing cards, wherein said at least one of said plurality of players has one of the following three options: move said at least one game piece of said at least one of said plurality of players from at least one of said plurality of base areas to at least one of said plurality of start spaces; send said at least one game piece of another of said plurality of players from said destination to at least one of said plurality of base areas; and move said at least one game piece of said at least one of said plurality of players back three of said advancement spaces on said advancement path, and wherein said plurality of wild cards each comprises a color stripe corresponding in color to one of said at least one game piece;

wherein a first one of said plurality of players is the first player to advance said at least one game piece to said destination; and declaring said first one of said plurality of players winner of said card game.

10. The method of claim 9 wherein said providing at least one game piece on each of said plurality of base areas comprises providing a plurality of game pieces on each of said plurality of base areas.

11. The method of claim 9 further comprising providing a plurality of checkpoint spaces corresponding in number to said plurality of base areas on said advancement path and wherein said having each of said players sequentially advance said at least one game piece from said each of said plurality of base areas on said advancement path comprises having said each of said players advance said at least one game piece on said plurality of checkpoint spaces.

12. The method of claim 11 wherein a plurality of said advancement spaces is provided between each of said plurality of checkpoint spaces and a corresponding one of said base areas and wherein said having each of said players sequentially advance said at least one game piece from said each of said plurality of base areas on said advancement path comprises having each of said players advance said at least one game piece on said plurality of advancement spaces provided between each of said plurality of checkpoint spaces and a corresponding one of said base areas.

13. The method of claim 12 wherein said plurality of said advancement spaces comprises six of said advancement spaces and wherein said having each of said players sequentially advance said at least one game piece from said each of said plurality of base areas on said advancement path comprises having said each of said players advance said at least one game piece on said six of said advancement spaces.

14. The method of claim 9 wherein said deck of playing cards comprises a deck of Iraqi Most Wanted playing cards and wherein said dealing a set of said deck of playing cards from said deck to each of a plurality of players comprises dealing a set of said deck of Iraqi most wanted playing cards to said each of said plurality of players.

15. The method of claim 9 wherein said deck of playing cards comprises a standard deck of playing cards and wherein said dealing a set of said deck of playing cards from said deck to each of a plurality of players comprises dealing a set of said standard deck of playing cards to said each of said plurality of players.

16. A method of playing a card game, comprising:

providing a game board having a plurality of base areas, a destination, an advancement path having a plurality of advancement spaces between said plurality of base areas and said destinations, a plurality of start spaces on said advancement path at said plurality of base areas, respectively, and a plurality of checkpoint spaces corresponding in number to said plurality of base areas on said advancement path;

providing a deck of playing cards;

dealing a set of said deck of playing cards from said deck to each of a plurality of players;

providing a plurality of game pieces on each of said plurality of base areas for each of said plurality of players;

placing one of said plurality of game pieces onto each of said plurality of start spaces;

having each of said players repeatedly and sequentially draw playing cards from said set of said playing cards;

having each of said players sequentially advance said plurality of game pieces from a corresponding one of said plurality of start spaces on said advancement path for numbers of said advancement spaces corresponding to numerical values displayed on said playing cards having at least one of said players advance one of said plurality of game pieces among said plurality of check point spaces by having said at least one of said players draw one of said plurality of playing cards having a numerical value of less than a predetermined number from said set of said playing cards;

wherein one of said players is a first player to advance said plurality of game pieces to said destination; and declaring said first player winner of said card game.

17. The method of claim 16 further comprising a plurality of wild cards provided in said deck of playing cards and having one of said plurality of players draw one of said plurality of wild cards from said set of said playing cards, wherein said one of said plurality of players has one of the following three options: move one of said plurality of game pieces from one of said plurality of base areas to one of said plurality of start spaces; send one of said plurality of game pieces of another of said plurality of players from said destination to one of said plurality of base camps; and move one of said plurality of game pieces back three of said advancement spaces on said advancement path, and wherein said plurality of wild cards each comprises a color stripe corresponding in color to one of said plurality of game pieces.

* * * * *